United States Patent [19]

Sesterhenn et al.

[11] 4,323,438

[45] Apr. 6, 1982

[54] ANODE FOR ALKALI METAL CHLORIDE ELECTROLYSIS

[75] Inventors: Lothar Sesterhenn, Dormagen; Milorad Tomic, Cologne, both of Fed. Rep. of Germany

[73] Assignee: Bayer Aktiengesellschaft, Leverkusen, Fed. Rep. of Germany

[21] Appl. No.: 132,564

[22] Filed: Mar. 21, 1980

[30] Foreign Application Priority Data

Apr. 10, 1979 [DE] Fed. Rep. of Germany ..... 2914414

[51] Int. Cl.[3] ..... C25B 1/26; C25B 1/42; C25B 11/03; C25B 11/10

[52] U.S. Cl. ..... 204/128; 204/219; 204/284; 204/288; 204/290 F; 204/279

[58] Field of Search ..... 204/99, 219-220, 204/250, 286, 128, 284, 290 F, 279

[56] References Cited

U.S. PATENT DOCUMENTS

| | | | |
|---|---|---|---|
| 3,676,325 | 7/1972 | Smith et al. | 204/286 X |
| 3,912,616 | 10/1975 | Ford | 204/286 |
| 4,121,994 | 10/1978 | Crippen et al. | 204/286 |

FOREIGN PATENT DOCUMENTS

| | | | |
|---|---|---|---|
| 2019806 | 11/1970 | Fed. Rep. of Germany | 204/286 |
| 2426674 | 12/1975 | Fed. Rep. of Germany | 204/284 |
| 2717931 | 10/1978 | Fed. Rep. of Germany | 204/286 |
| 1235570 | 6/1971 | United Kingdom . | |
| 1290009 | 9/1972 | United Kingdom . | |

*Primary Examiner*—D. R. Valentine

*Attorney, Agent, or Firm*—Sprung, Felfe, Horn, Lynch & Kramer

[57] ABSTRACT

In an anode of a cell for alkali metal chloride electrolysis by the amalgam method and comprising a grid-like or net-like level titanium anode surface, optionally current distributing rails, a bridge acting as a primary conducting rail and at least one copper bolt as a current supply means, the improvement wherein the copper bolt has a screw thread, the bridge having a threaded passage for receiving the screw thread and a conical passage for receiving the conical portion of the copper bolt, the copper bolt and bridge being screwed together in a force- and form-locking manner.

4 Claims, 1 Drawing Figure

ANODE FOR ALKALI METAL CHLORIDE ELECTROLYSIS

Figure 1:
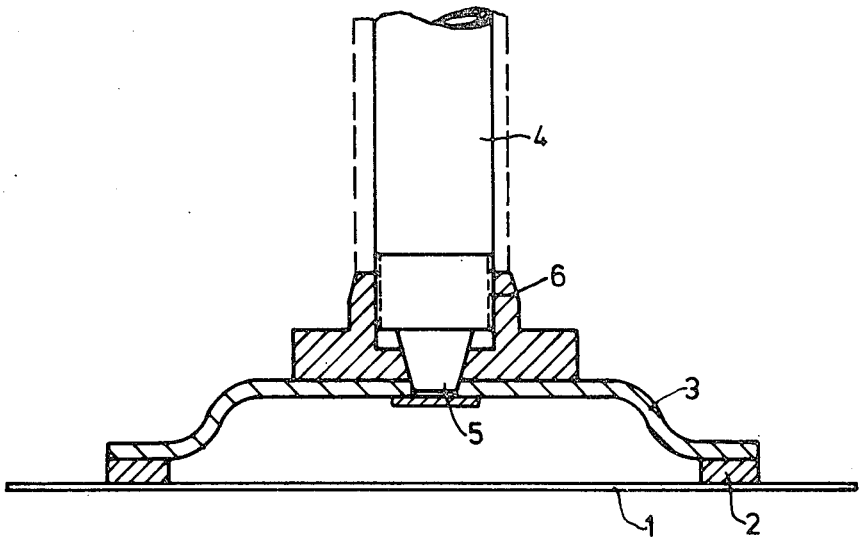

During alkali metal chloride electrolysis by the amalgam method (Winnacker, Küchler, ed.: Chemische Technologie, volume 1, pages 250–260, 1969), the graphite anodes which were normally used in the past have been superseded more recently by titanium anodes provided with active coatings (German Offenlegungsschrift No. 1,814,567). Titanium anodes comprise a grid-like or net-like titanium anode surface which is arranged opposite and parallel to the mercury cathode and is immersed in the electrolyte covering the mercury cathode. Titanium anodes also comprise transverse conductors of relatively large cross-section which are firmly welded to the titanium anode surface and which are also welded to a bridge which has an even larger cross-section and is made of titanium. In this way good mechanical stability is achieved in the titanium anode surface, and the current is distributed as uniformly as possible over the entire anode surface. The current is usually supplied via copper bolts which are arranged perpendicularly to the titanium structure and are electrically connected to the bridge.

It is difficult to fix the copper bolts to the bridge of the titanium structure. The connection between the titanium structure and the copper bolts should provide a good mechanical connection as the titanium structure is held by copper bolts and, once an adjustment has been made, it should be ensured for prolonged periods, and it should also provide a good electrical contact. In addition it should be possible to release the titanium structure from the copper bolt without a great amount of effort and without damaging the contacting surface, thus making it easy to manipulate the titanium structure when the active coating of the titanium anode surface has to be renewed at regular intervals.

Numerous methods of producing this connection have been proposed.

German Offlegungsschrift No. 2,031,525 proposes, for example, that the electric contact between the copper bolt and the bridge of the titanium structure be produced by means of a metal alloy which has a low melting point and is liquid under the operating conditions of the electrolysis cell. In this arrangement, the mechanical connection is additionally ensured by a screwed joint. The problems arising from this suggestion lie firstly in the fact that these low melting point alloys do not generally wet titanium, to the detriment of the good electrical contact, and secondly in that it becomes more difficult to remove the copper bolt.

It is proposed in German Offenlegungsschrift No. 27 17 931 that a cone fits in a hollow cone in the bridge provided at the lower end of the copper bolt and that the bridge and copper bolt be screwed together by means of a screw engaging in a screw-threaded passage in the copper bolt. This solution does not provide a sufficiently long-lasting contact either.

An object of the present invention is therefore to provide an anode for alkali metal chloride electrolysis which avoids the said disadvantages. The present invention relates to an anode for alkali chloride electrolysis by the almalgam method, consisting of a level grid-like or net-like titanium anode surface, optionally current distributing rails, a bridge acting as primary conductor rail and at least one copper bolt as a current supply means, which is characterized in that the copper bolt has a screw thread in its lower region and is conical below the screw thread, the bridge has a screw nut and a conical passage for receiving the conical region of the copper bolt, and the copper bolt and bridge are screwed together in a force- and locking form-manner.

It has been found that the conical surfaces of the copper bolt and bridge of the anode structure which are pressed together by the screwed joint ensure an excellent electrical connection. This is achieved, in particular, by pressing the conical surfaces and at the same time twisting them against each other during the screwing operation.

In a variation of the invention, the conical surfaces on the copper bolt and/or the bridge can be protected from corrosion by metallizing the surfaces. For example, nickel and platinum coatings are suitable.

The ratio of taper of the cone is preferably between 1:5 and 1:15, and a ratio of taper of about 1:10 is preferred.

The invention is described in more detail by way of an example, with reference to the accompanying drawing which is an elevation of an anode in accordance with the invention, portions being shown in section. Meanings: 1 grid-like or net-like titanium anode surface, 2 current distributing rails, 3 bridge, 4 copper bolt, 5 conical surface, 6 screw thread.

The present invention also relates to a method of producing chlorine by electrolysis of alkali chloride using the anode according to the invention.

It will be appreciated that the instant specification and examples are set forth by way of illustration and not limitation, and that various modification and changes may be made without departing from the spirit and scope of the present invention.

What is claimed is:

1. In an anode of a cell for alkali metal chloride electrolysis by the amalgam method and comprising a grid-like or net-like level titanium anode surface, optionally current distributing rails, a bridge acting as a primary conducting rail and at least one copper bolt as a current supply means, the improvement wherein the copper bolt has a screw thread in its lower region and below the screw thread is conical with a taper of from about 1:5 to 1:15, the bridge having a threaded passage for receiving the conical portion of the copper bolt, the copper bolt and bridge being screwed together in a force- and form-locking manner.

2. An anode according to claim 1, wherein at least one of the conical surfaces is coated with a corrosion-resistant metal.

3. An anode according to claim 2, wherein the ratio of taper of the cone is about 1:10.

4. In the production of chlorine by electrolysis of alkali metal chloride, the improvement which comprises employing an anode according to claim 1.

* * * * *